United States Patent [19]

Morris et al.

[11] Patent Number: 4,801,906

[45] Date of Patent: Jan. 31, 1989

[54] MOLDED CASE CIRCUIT BREAKER TRIP INDICATOR UNIT

[75] Inventors: Robert A. Morris, Burlington; Yuet-Ying Yu, Danbury, both of Conn.

[73] Assignee: General Electric Company, New York, N.Y.

[21] Appl. No.: 110,239

[22] Filed: Oct. 19, 1987

[51] Int. Cl.[4] ..... H01H 73/12

[52] U.S. Cl. ..... 335/17; 335/13

[58] Field of Search ..... 335/13, 17; 337/79; 200/308

[56] References Cited

U.S. PATENT DOCUMENTS

| | | | |
|---|---|---|---|
| 3,171,927 | 3/1965 | Klein | 337/79 |
| 3,562,733 | 2/1971 | Murphy | 335/17 |
| 4,297,663 | 10/1981 | Seymour et al. | 335/20 |
| 4,589,052 | 5/1986 | Dougherty | 361/94 |
| 4,622,444 | 11/1986 | Kandatsu et al. | 200/303 |
| 4,649,455 | 3/1987 | Scott | 361/93 |
| 4,679,016 | 7/1987 | Ciarcia et al. | 335/132 |
| 4,679,019 | 7/1987 | Todaro et al. | 335/172 |
| 4,700,161 | 10/1987 | Todaro et al. . | |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the circuit breaker cover from the environment. A trip signal indicator is one such accessory component which can be field-installed without affecting the integrity of the circuit breaker overcurrent protection components.

16 Claims, 4 Drawing Sheets

MOLDED CASE CIRCUIT BREAKER TRIP INDICATOR UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the part, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No. 4,700,161 entitled "Combined Trip Unit and Accessory Module for Electronic Trip Circuit Breakers". The aforementioned U.S. Patents which represent the advanced state of the art of circuit protection devices are incorporated herein for reference purposes.

When the integrated protection unit is located remotely from the protected industrial equipment, it is important for the equipment operator to ascertain the status of the operating power supplied to the equipment. Should an overcurrent condition occur causing the circuit breaker to interrupt the equipment operating power, some means must be employed to provide immediate visual and audible indication to the equipment operator. One purpose of the instant invention is to provide a trip signal indicator unit to circuit breakers which is field-installable and which is capable of indicating the occurrence of a trip operation to a location remote from the circuit breaker.

SUMMARY OF THE INVENTION

An integrated protection unit which includes overcurrent protection along with auxiliary accessory function, contains an access cover for the selected accessory components, to allow field installation of the accessory components prior to connecting the integrated protection unit within an electric circuit. One such accessory unit comprises a field-installable trip signal indicator unit which is installed in the circuit breaker cover next to the trip actuator. When the circuit breaker is tripped, the trip signal indicator interacts with the trip actuator to provide an output signal to a remote audible alarm and indicating light.

DESCRIPTION OF THE PREFERRED EMBODIMENT

Figure 1:
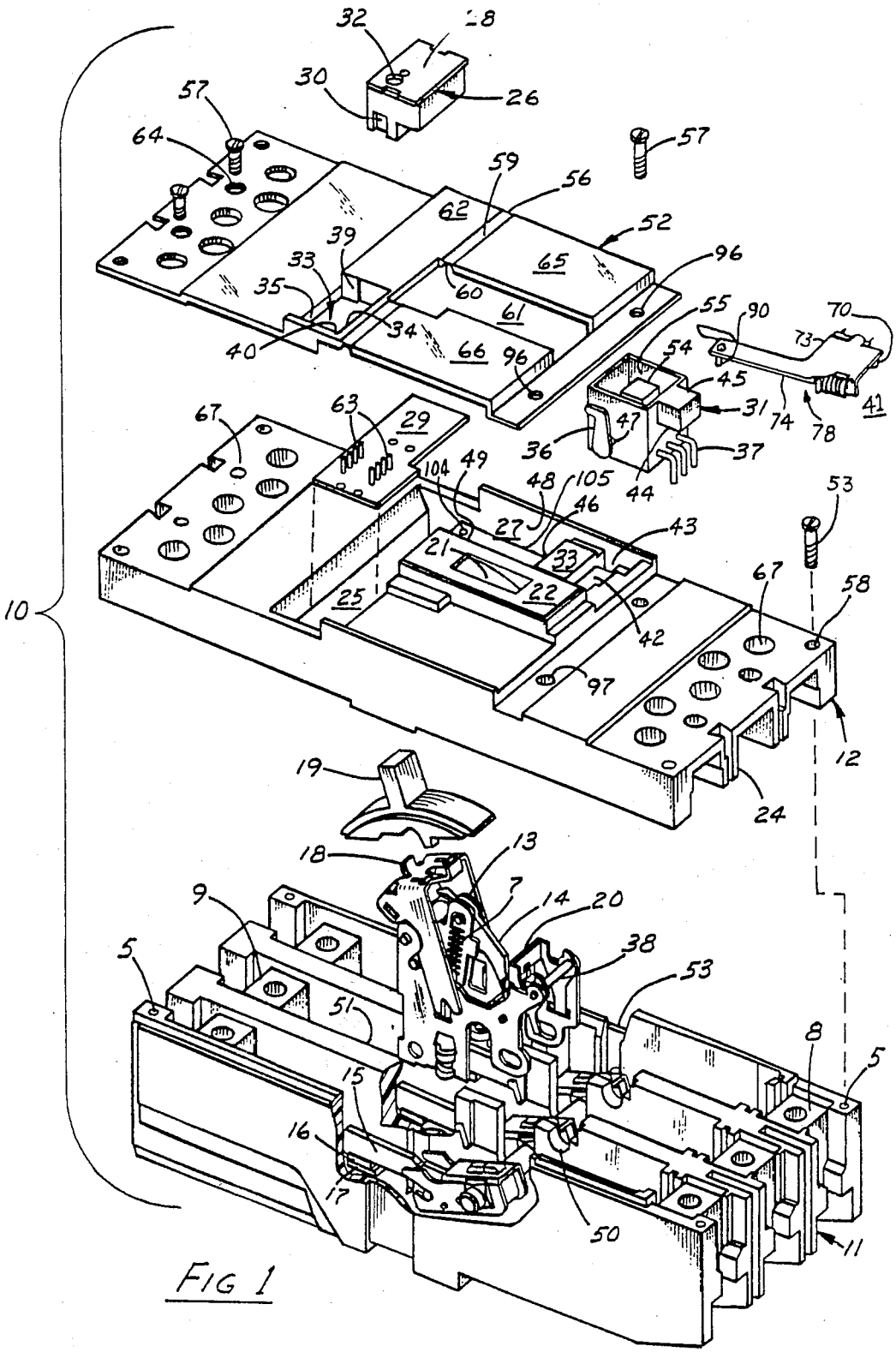
FIG. 1 is an exploded top perspective view of an integrated protection unit containing the trip signal indicator unit according to the invention.

An integrated protection unit circuit breaker 10 is shown in FIG. 1 prior to assembly at the point of manufacture. The integrated protection unit circuit breaker or "integrated circuit breaker" is defined herein as a molded case circuit breaker having an electronic trip unit for overcurrent protection and which also includes at least one auxiliary electrical accessory. The accessories commonly employed with molded case circuit breakers include auxiliary switches, shunt trip elements, and undervoltage sensing units. The integrated circuit breaker 10 contains a case 11 and a cover 12. The integrated circuit breaker case 11 which connects with an external circuit by means of line lugs 8 and load lugs 9 supports an operating mechanism generally depicted at 13 which includes an operating cradle 14 for restraining a movable contact carrier 15 and movable contact 16 from separating away from a fixed contact 17 against the urgence of a pair of powerful operating springs 7 mounted on both sides of the operating mechanism. One end of the operating cradle 14 is retained within a latch 20 which allows the movable contact carrier 15 to be moved between its closed and open positions by manual operation of the handle yoke 18 operatively connected with the handle 19. A trip bar 38 arranged next to a trip lever 36 extending from a trip actuator 31 disengages the latch 20 from the operating cradle 14 to allow the operating mechanism 13 rapidly drive the movable contact carrier 15 to its tripped position. A good description of the operating mechanism 13 is found within U.S. Pat. No. 4,679,016 entitled "Interchangeable Mechanism for Molded Case Circuit Breaker", which Patent is incorporated herein for purposes of reference. The integrated circuit breaker cover 12 is attached to the case 11 by the insertion of screws 53 through corresponding openings 58 through the integrated circuit breaker cover 12 and corresponding openings 5 formed within opposite ends of the integrated circuit breaker case 11. When the integrated circuit breaker cover is attached to the integrated circuit breaker case, the downwardly extending walls 24 of the integrated circuit breaker cover align with corresponding phase barrier walls 51 integralle formed within the integrated circuit breaker case to electrically isolate the components contained within the separate phases when the integrated circuit breaker is connected within a multiphase electric circuit. As described within aforementioned U.S. Pat. No. 4,700,161, a slot 50 formed within one of the phase barrier walls 51 supports the trip actuator shaft 47 and allows the trip lever 36 to operatively react with the trip bar 38 to trip the breaker, as described earlier. The printed wire board 29 which contains the electronic trip unit circuit described within aforementioned U.S. Pat. No. 4,589,052 is mounted within an elongated trip unit recess 25 formed within the integrated circuit breaker cover. The trip actuator 31 is assembled within the trip actuator recess 27 formed within the integrated circuit breaker cover on the opposite side of the cover inner escutcheon 22 through which the operating handle slot 21 is formed and connects with the printed wire board 29 by means of wire conductors 37. The actuator recess 27 is defined by a pair of opposing side walls 48, 49 and a front wall 46 as indicated. The bottom 44 of a projection 45 on the trip actuator is supported on the integrated circuit breaker cover by means of a support block 33 integrally formed within the cover. Access to the components 54 within the trip actuator for selecting the various accessory options described within the aforementioned U.S. Pat. No. 4,679,019, is made through the open top portion 55. A shallor trip indicator unit recess 42 is formed ahead of the trip actuator recess 27 for containing the trip indicator unit 41. In accordance with the instant invention, the trip indicator unit comprises one of the auxiliary switches described earlier. The pivot pin 90 serves to exactly locate the trip indicator unit 41 on the circuit breaker cover 12 by positioning within the locating hole 104 formed in the platform 105. This locates the arm 74 of the L-shaped indicator support housing 78 on the platform 105 and positions the leg 73 of the support housing 78 within the trip indicator unit recess 42 in cooperation with the tab 70 which will be discussed below in greater detail. The lead wires 37 from the trip actuator 31 extend down through a slot 43 formed through the bottom of the integrated circuit breaker cover. The trip unit printed wiring board 29 is inserted within the trip unit recess 25 and the accessory cover 52 is attached to the integrated circuit breaker cover 12 by means of screws 57, openings 64 formed in the accessory cover 52 and openings 67 formed in the integrated circuit breaker cover 12. The rating plug 26 is next inserted within the rating plug recess 33 consisting of front and rear walls 34, 35 and opposing side walls 39, 40 formed within the accessory cover 52. The rating plug is described within U.S. patent application Ser. No. 045,645 which Application is incorporated herein for reference purposes. The rating plug is electrically connected with the trip unit printed wire board 29 by the insertion of a plurality of contacts 30 on the bottom of the rating plug within a corresponding plurality of contact connectors 63 extending from a top surface of the printed wiring board. When the rating plug is inserted within the rating plug recess, the top surface 28 of the rating plug is coplanar with a central region 62 on the accessory cover 52. A test jack opening 32, formed within the top surface of the rating plug, allows for external access to the rating plug circuit contained within the trip unit printed wiring board 29. A good description of the rating plug circuit is found within U.S. Pat. No. 4,649,455, which Patent is incorporated herein for purposes of reference. With the accessory cover 52 secured to the top surface of the integrated circuit breaker cover 12, the inner escutcheon 22 on the integrated circuit breaker cover extends within an elongated opening 61 defined between the pair of accessory doors 65, 66 formed within the accessory cover 52. The accessory doors 65, 66 each include a "living" hinge, generally depicted at 56, which comprises a radial slot 60 extending along the bottom surface of the door at one end and a rectangular slot 59 extending along the top surface of the door coextensive with the radial slot. The slots 58, 60 provide a reduced thickness to the material in the vicinity of the hinge which allows the doors to pivot to and remain in an open position. A pair of thru-holes 96 formed within the accessory doors 65, 66 at the ends opposite from the living hinges allows the accessory cover to be attached to the integrated circuit breaker cover by means of screws 57 and threaded screw holes 97 formed within the integrated circuit breaker cover.

Figure 2:
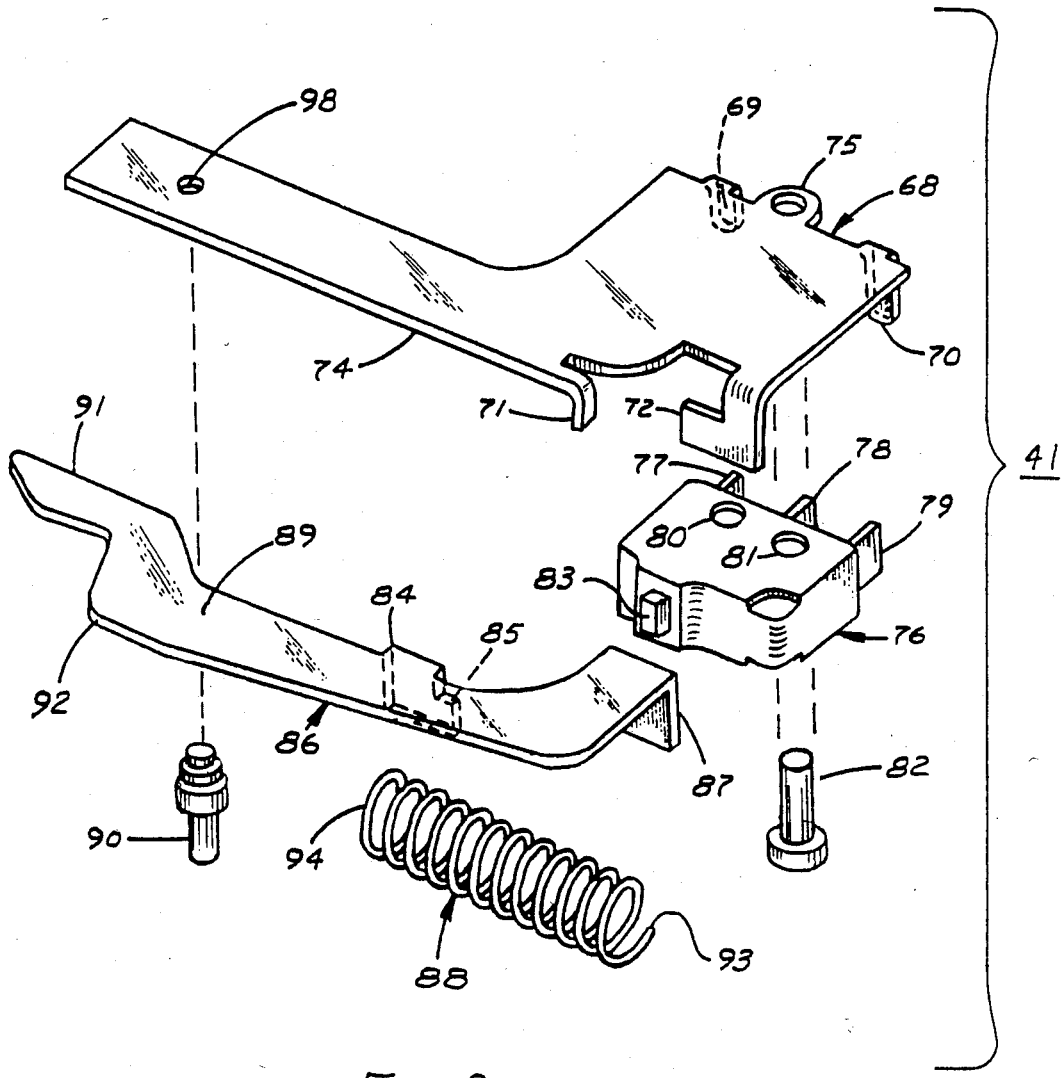
FIG. 2 is a top perspective view of the trip signal indicator unit within the integrated protection unit of FIG. 1.

The trip indicator unit 41 is assembled in a manner depicted in FIG. 2 wherein an electric switch 76 is attached to the underside of an L-shaped metal support housing 68 by positioning a vertical tab 69 depending from the housing within a thru-hole 80 formed in the switch and then positioning a rivet 82 through a separate thru-hole 81, then through an eyelet projection 75 and flattening the top of the rivet. The remaining depending tab 70 assists in locating the trip indicating unit with respect to the trip actuator 31 shown earlier in FIG. 1. The electric switch can be electrically connected in either a normally "open" or normally "closed" configuration by means of contact blades 77, 78 and 79. The switch contact blades are both internally connected and disconnected by means of a plunger 83. The plunger is acted upon by means of the angled end 87 of a bell crank lever 86 which is next positioned under the L-shaped support housing 68 and attached thereto by means of apivot pin 90 which extends through a thruhole 89 formed near the offset end 91 of the bell crank lever 86 and then through an opening 98 formed through the L-shaped support housing arm 74 and is flattened to securely hold the bell crank lever to the L-shaped support housing while allowing the lever to rotate about the pivot pin sufficient to bring the angled end 87 in and out of abutment with the plunger 83. A compression spring 88 is next positioned on the trip indicator unit by trapping an angled tab 72 formed on the L-shaped housing 68 within one end 93 of the compression spring and trapping an end 85 of an angled tab 84 formed on the bell crank lever within an opposite end 94 of the compression spring 88. The bell crank lever 86 includes a camming surface 92 formed between the thru-hole 89 on the bell crank lever and the offset end 91. The bent tab 71 on the L-shaped support 68 positions and retains the compression spring 88 between the angled tabs 72, 84 as best seen in FIG. 3.

Figure 3:
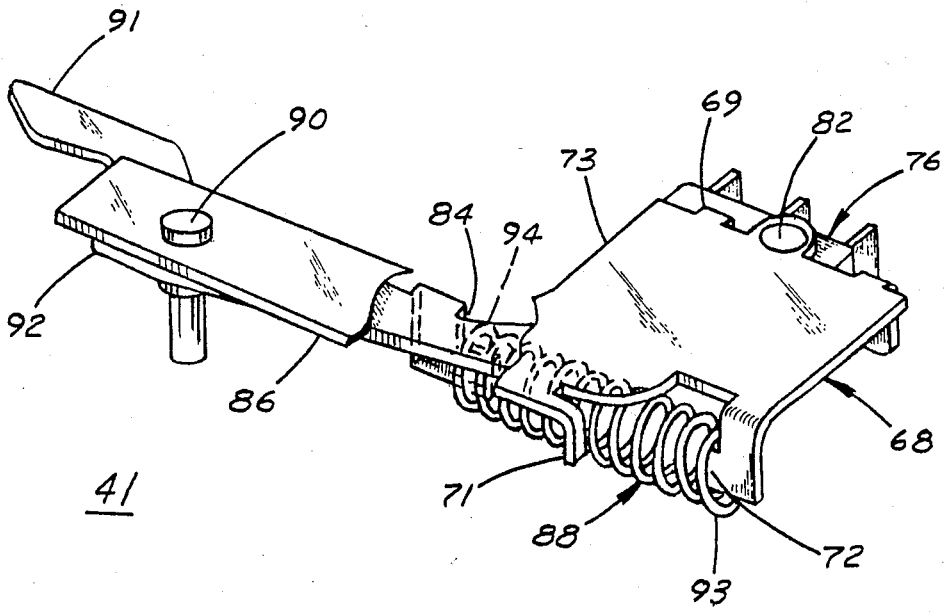
FIG. 3 is a plan view of the assembled trip signal indicator unit of FIG. 2.

The assembled trip indicator unit 41 is depicted in FIG. 3 to show the attachment of the switch 76 to the leg 73 of L-shaped support 68 by means of the flattened rivet 82 and the vertical tab 69. The positioning of the compression spring 88 by means of spring ends 93, 94 and the angled tabs 72, 84 is an important feature of the instant invention. The compression spring allows the bell crank lever 86 to pivot around the pivot post 90 by application of a bias force to the bell crank lever via the angled tabs 84. The camming surface 92 on the offset end 91 interfaces with the trip lever 36 of FIG. 1 to control the movement of the bell crank lever as described as follows.

Figure 4A:
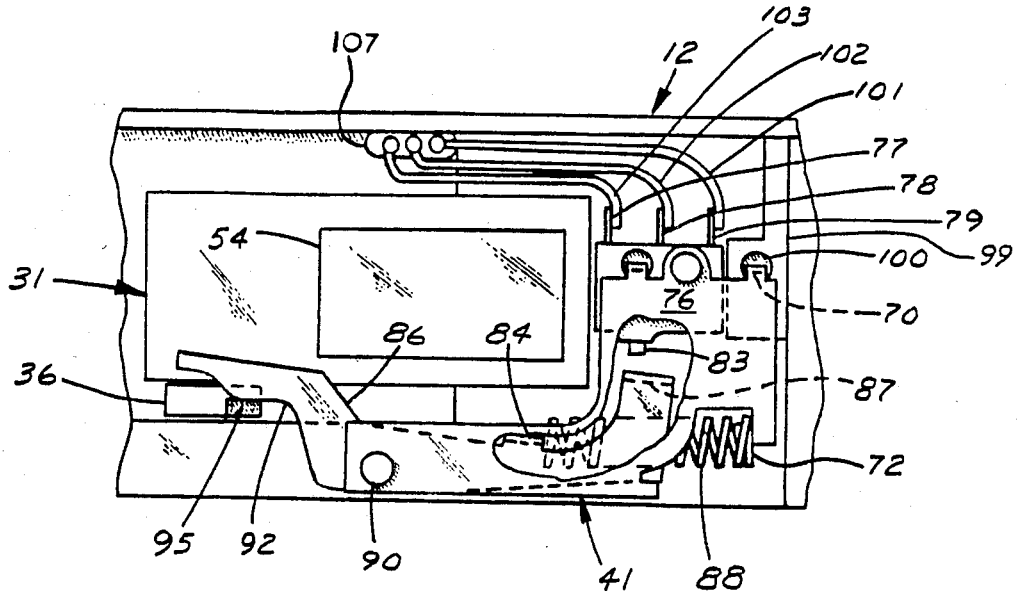
FIG. 4A is a plan view of a part of the integrated protection unit of FIG. 1 depicted in a latched condition.
Figure 4B:
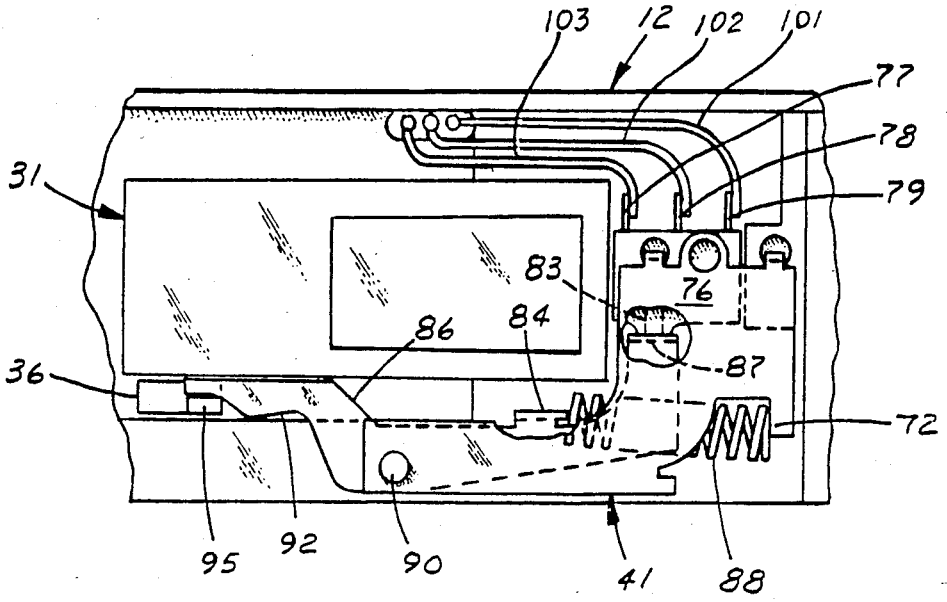
FIG. 4B is a plan view of the integrated protection unit of FIG. 1 depicted in a tripped condition.

The trip indicator unit 41 is shown attached to the top of the integrated circuit breaker cover 12 in FIGS. 4A and 4B. The vertical tab 70 depending from the trip indicator unit is inserted within a hole 100 formed in a support 99 which is attached to the integrated circuit breaker cover 12. This locates and aligns the camming surface 92 on the end of the bell crank lever 86 in abutment with a trip lever projection 95 formed onto the trip lever 36 of the trip actuator 31. The trip unit is in a latched condition resulting in the latched configuration shown in FIG. 4A wherein the angled end 87 of the bell crank lever 86 is out of contact with the plunger 83. The electrical status between the contact blades 77–79 which is transmitted to a remote location by means of wire conductors 101–103 through wire access slot 107 is that of a breaker "latched" condition. The compression spring 88 extends linearly between the angled tabs 72, 84 as indicated. Upon the occurrence of a trip operation within the integrated circuit breaker 10 of FIG. 1, the trip lever 36, by operation of components 54 within the trip actuator 31, moves to the tripped position indicated in FIG. 4B carrying the trip lever projection 95 out from abutment with the camming surface 92 on the bell crank lever 86 causing the bell crank lever to rotate counterclockwise about the pivot pin 90 driving the angled end 87 into contact with the plunger 83 on the switch 76 and depressing the plunger within the switch. The electrical status between the contact blades 77–79 is thus changed accordingly. A remote bell and indicating light (not shown) which are electrically connected to the wire conductors 101–103 will then operate to indicate at a location remote from the integrated circuit breaker, that a trip condition has occurred. The bell crank lever 86 remains in the tripped position against the return bias provided by the displacement of the compression spring 88 between the angled tabs 72, 84 as indicated. When the circuit breaker operating mechanism 13 of FIG. 1 is reset, and the trip lever 36 returns to the latched position indicated in FIG. 4A the trip lever projection 95 again moves into abutment with the camming surface 92 on the bell crank lever thereby displacing the angled end 87 away from the plunger 83.

It has thus been shown that a simple trip indicating unit can be operatively connected with an integrated circuit breaker to provide remote indication of the condition of the circuit breaker contacts. The selfcontained trip indicator unit design allows the trip indicator unit to be easily field-installable.

Having thus described my invention, what I claim as new and desire to secure by Letters Patent is:

1. A circuit breaker trip signal indicator comprising:
- a support;
- an electric switch fixedly attached to one end of said support, said electric switch having a plunger button;
- a bell crank lever pivotally attached to an opposite end of said support, said bell crank lever having an angled end for interacting with said plunger button to turn said switch on and off and a camming surface proximate an end of said bell crank lever opposite said angled end for interacting with a circuit breaker trip lever; and
- a spring connecting between said support and said bell crank lever, said spring biasing said switch in said off position.

2. The circuit breaker trip signal indicator of claim 1 wherein said support comprises an L-shaped configuration.

3. The circuit breaker trip signal indicator of claim 1 wherein said electric switch includes a first thruhole, said thru-hole receiving a first tab depending from a bottom of said support to position said electric switch at a predetermined location on said support.

4. The circuit breaker trip signal indicator of claim 3 including a second thru-hole through said electric switch and an eyelet projection on said support for attaching said electric switch to said support.

5. The circuit breaker trip signal indicator of claim 1 including an angled tab on said support and an angled tab on said bell crank lever, one end of said spring being retained by means of said support angled tab and another end of said spring being retained by means of said bell crank angled tab.

6. The circuit breaker trip signal indicator of claim 1 wherein said spring comprises a compression spring.

7. The circuit breaker trip signal indicator of claim 5 including a third angled tab depending from said support abutting said spring and positioning said spring intermediate said third tab and said electric switch.

8. The circuit breaker trip signal indicator of claim 1 wherein said electric switch includes three contact connectors.

9. A circuit breaker trip indicator unit comprising:
- an elongated support member having an L-shaped configuration and including an angled tab extending therefrom;
- an elongated bell crank lever pivotally attached to said support member by means of a pivot pin and including a bent tab extending therefrom;
- an electric switch attached to said support and arranged proximate one end of said lever whereby a first bent tab on said lever one end moves into contact with a plunger on said switch to activate said switch and moves out of contact with said plunger to inactivate said switch, said lever including a second bent tab to said bell crank lever intermediate said one end and an opposite end; and
- a spring connecting between said support member and said bell crank lever for biasing said bell crank lever and said switch to the non-activated condition said spring being captured between said angled tab on said L-shaped support member and said angled tab on said bell crank lever.

10. The trip indicator of claim 9 wherein said support member includes an arm and a leg said arm being perpendicular to said leg.

11. The trip indicator of claim 9 wherein said spring comprises a compression spring.

12. The trip indicator of claim 10 including a second tab on said leg on a side of said leg opposite said first tab for supportingly abutting an opposite side of said switch.

13. The trip indicator unit of claim 12 including an apertured tab extending from said opposite side of said support and a thru-hole within said switch, whereby a fastener extends through said thru-hole and said apertured tab to fixedly attach said switch to said support.

14. A circuit breaker having remote trip indicating facility comprising, in combination:
- a molded plastic case and cover;
- a pair of seperable contacts and an operating mechanism for opening and closing said contacts within said case;
- actuator means within said cover for articulating said operating mechanism upon predetermined electric circuit current through said contacts;

an indicator unit within said cover for providing external indication when said operating mechanism is articulated, said indicator unit including an electric switch mounted on an elongated support and interacting with a bell crank lever pivotally attached to said support;

a compression spring connecting between said support and said bell crank lever to bias said bell crank lever away from said switch; and said bell crank lever being attached to said support by a pivot pin and said indicator unit being positioned within a recess formed within said cover, said recess including an opening at a predetermined location through said recess, whereby positioning an end of said pivot pin within said opening locates said indicator unit at a predetermined location within said recess.

15. The circuit breaker of claim 14 wherein said end of said bell crank lever interactively abuts an end of said actuator unit within said cover.

16. The circuit breaker of claim 15 further including a tab depending from said indicator unit and extending within an opening within said recess to position said indicator unit within said recess in cooperation with said pivot pin.

* * * * *